US009822591B2

(12) United States Patent
Granger et al.

(10) Patent No.: US 9,822,591 B2
(45) **Date of Patent: *Nov. 21, 2017**

(54) TUBULAR COMPONENT FOR DRILLING AND OPERATING HYDROCARBON WELLS, AND RESULTING THREADED CONNECTION

(75) Inventors: Scott Granger, Valenciennes (FR); Olivier Caron, Ramecourt (FR); Eric Verger, Gommegnies (FR)

(73) Assignees: VALLOUREC OIL AND GAS FRANCE, Aulnoye-Aymeries (FR); SUMITOMO METAL INDUSTRIES, LTD., Osaka-shi (JP)

( * ) Notice: Subject to any disclaimer, the term of this patent is extended or adjusted under 35 U.S.C. 154(b) by 1211 days.

This patent is subject to a terminal disclaimer.

(21) Appl. No.: 13/260,138

(22) PCT Filed: Apr. 9, 2010

(86) PCT No.: PCT/EP2010/002215

§ 371 (c)(1),
(2), (4) Date: Oct. 7, 2011

(87) PCT Pub. No.: WO2010/118839

PCT Pub. Date: Oct. 21, 2010

(65) Prior Publication Data

US 2012/0025522 A1 Feb. 2, 2012

(30) Foreign Application Priority Data

Apr. 17, 2009 (FR) ..... 09 01888

(51) Int. Cl.
*F16L 15/00* (2006.01)
*E21B 17/042* (2006.01)

(52) U.S. Cl.
CPC ..... *E21B 17/0423* (2013.01)

(58) Field of Classification Search
CPC ..... F16L 15/00; F16L 15/06; E21B 17/0423
(Continued)

(56) References Cited

U.S. PATENT DOCUMENTS 3,989,284 A 11/1976 Blose
5,154,452 A 10/1992 Johnson
(Continued)

FOREIGN PATENT DOCUMENTS

CN 101010536 A 8/2007
CN 101163850 A 4/2008
(Continued)

OTHER PUBLICATIONS

International Search Report dated Jun. 29, 2010 in PCT/EP10/002215 Filed Apr. 9, 2010.

*Primary Examiner* — David E Bochna
*Assistant Examiner* — James A Linford
(74) *Attorney, Agent, or Firm* — Oblon, McClelland, Maier & Neustadt, L.L.P.

(57) ABSTRACT

A tubular component for a threaded connection includes at one of its ends a threaded zone. The end includes a terminal surface and the threaded zone includes, over at least a portion, threads including, when viewed in a longitudinal section passing through an axis of the tubular component, a thread crest, a thread root, a load flank, and a stabbing flank, such that a respective axial width of thread crests decreases in a direction of the terminal surface while a respective axial width of thread roots increases when considered in the same direction. At least one of a profile of the load flank and a profile of the stabbing flank of a thread portion includes, as a contral portion, a continuous curve provided with a point of inflection such that the profile with the point of inflection in convex at the thread crest and concave close to the thread root.

12 Claims, 2 Drawing Sheets

(58) Field of Classification Search
USPC ..... 285/333
See application file for complete search history.

(56) References Cited

U.S. PATENT DOCUMENTS

| | | | | |
|---|---|---|---|---|
| RE34,467 | E | 12/1993 | Reeves | |
| 6,174,001 | B1 | 1/2001 | Enderle | |
| 6,254,146 | B1 | 7/2001 | Church | |
| 7,562,911 | B2 | 7/2009 | Reynolds, Jr. et al. | |
| 8,827,322 | B2 * | 9/2014 | Granger et al. | 285/334 |
| 2003/0067169 | A1 | 4/2003 | Church | |
| 2006/0145477 | A1 * | 7/2006 | Reynolds | 285/333 |
| 2006/0201669 | A1 * | 9/2006 | Sivley et al. | 166/77.51 |
| 2006/0220382 | A1 | 10/2006 | Reynolds et al. | |
| 2010/0171305 | A1 | 7/2010 | Roussie et al. | |
| 2011/0101684 | A1 * | 5/2011 | Leng | 285/332.2 |

FOREIGN PATENT DOCUMENTS

| | | | |
|---|---|---|---|
| JP | 52-1528 | | 1/1977 |
| WO | WO 2006/022418 | A1 | 3/2006 |
| WO | WO 2006/073902 | A2 | 7/2006 |

* cited by examiner

TUBULAR COMPONENT FOR DRILLING AND OPERATING HYDROCARBON WELLS, AND RESULTING THREADED CONNECTION

The present invention relates to a tubular component used for drilling and operating hydrocarbon wells, and more precisely the end of such a component, said end being of the male or female type and capable of being connected to a corresponding end of another component also used for drilling and operating hydrocarbon wells. Thus, the invention also relates to a threaded connection resulting from connecting two tubular components by make-up.

The term "component used for drilling and operating hydrocarbon wells" means any element with a substantially tubular shape intended to be connected to another element of the same type or not in order, when complete, to constitute either a string for drilling a hydrocarbon well or a riser for maintenance such as a work over riser, or for operation such as production risers, or a casing string or a tubing string involved in operating a well. The invention is of particular application to components used in a drill string such as drill pipes, heavy weight drill pipes, drill collars and the parts which connect pipes and heavy weight pipes known as tool joints.

In known manner, each component used in a drill string generally comprises an end provided with a male threaded zone and/or an end provided with a female threaded zone each intended to be connected by make-up with the corresponding end of another component, the assembly defining a connection. The drill string constituted thereby is driven from the surface of the well in rotation during drilling; for this reason, the components have to be made up together to a high torque in order to be able to transmit a rotational torque which is sufficient to allow drilling of the well to be carried out without break-out or even over-torquing.

In conventional products, the make-up torque is generally achieved thanks to cooperation by tightening of the abutment surfaces provided on each of the components which are intended to be made up. However, because of the fact that the extent of the abutment surfaces is a fraction of the thickness of the tubes, the critical plastification threshold of the abutment surfaces is reached rapidly when too high a makeup torque is applied.

For this reason, threadings have been developed which can relieve the abutment surfaces of at least a portion or even all of the loads which they are not capable of taking up. The aim was achieved by using self-locking threadings such as those described in the prior art document U.S. Re 30 647 and U.S. Re 34 467. In this type of self-locking threads, the flanks of the threads (also termed teeth) of the male end and the threads (also termed teeth) of the female end have a constant lead but the thread widths are variable.

More precisely, the widths of the thread crests (or teeth) increase progressively for the threads of the male end, respectively of the female end, with distance from the male end, respectively from the female end. Thus, during make-up the male and female threads (or teeth) finish up locking into each other in a position corresponding to a locking point.

More precisely still, locking occurs for self-locking threadings when the flanks of the male threads (or teeth) lock against the flanks of the corresponding female threads (or teeth). When the locking position is reached, the male and female threaded zones made up into each other have a plane of symmetry along which the width at the common mid-height of the male and female teeth located at the end of the male threaded zone corresponds to the width at the common mid-height of the male and female teeth located at the end of the female threaded zone.

For this reason, the make-up torque is taken up by all of the contact surfaces between the flanks, i.e. a total surface area which is much larger than that constituted by the abutment surfaces of the prior art.

In order to reinforce the interlock of the male threads with the female threads, the male and female threads (or teeth) have a dovetail profile so that they are solidly fitted one inside the other after make-up. This dovetail configuration means that risks of jump-out, which corresponds to the male and female threads coming apart when the connection is subjected to large bending or tensile loads, are avoided. More precisely, the geometry of dovetail threads increases the radial rigidity of a connection compared with "trapezoidal" threads as defined in API5B, where the axial width reduces from the base of the thread to the thread crest, and compared with "triangular" threads such as those defined in API7.

However, the dovetail configuration suffers from several disadvantages. Firstly, the fact that the thread flanks make a negative angle with the axis that passes through the thread roots (i.e. an angle which is the inverse of that used in the case of a trapezoidal thread configuration) increases the risks of the male and female threads grabbing when making up or breaking out a connection.

Next, the fact that the width of the thread crests is greater than the width of the thread bases implies some degree of sensitivity as regards fatigue strength. Thus, it has been shown that when the connection operates in alternating bending, the thread (or teeth) flanks of the end of the male threaded zone are subjected to a high degree of shear stress, which may cause the male teeth to be torn. Similarly, when the connection operates in alternating bending, the thread (or teeth) flanks of the end of the female threaded zone are also subjected to a high degree of shear stress, which may cause the female teeth to be torn. This fatigue sensitivity increases all the more as the rounding radii of the stabbing flanks and the load flanks to the crests and roots of the threads are small. In fact, such small rounding radii become stress concentration factors.

In order to overcome this problem, document U.S. Pat. No. 6,254,146 proposes a three-faceted flank configuration. Thus, two facets respectively form an angle which is termed "positive" with the thread crest and root defining a median facet which extends in a direction forming an angle with the thread crest and root which is termed "negative". For this reason, the threads have a generally dovetail profile and the flanks are connected to the thread crest and thread root by means of much smaller radii. However, this configuration suffers from major disadvantages at the obtuse angles which the median facet forms with its neighbours. More precisely, the small radii connecting the median facet to the neighbouring facets are also the seats of stress concentrations and there is a risk of galling during make-up and break-out operations.

More precisely, the invention concerns a tubular component for a threaded connection, having at one of its ends a threaded zone formed on its external or internal peripheral surface depending on whether the threaded end is of the male or female type, said end finishing in a terminal surface, said threaded zone having, over at least a portion, threads comprising, when viewed in longitudinal section passing through the axis of the tubular component, a thread crest, a thread root, a load flank, a stabbing flank, the width of the thread crests reducing in the direction of the terminal surface while the width of the thread roots increases, characterized in that the profile of the load flanks and/or the stabbing flanks, viewed in longitudinal section passing through the axis of the tubular component, has as a central portion a continuous curve provided with a point of inflection (I), said profile being convex at the thread crest and concave at the thread root.

Optional complementary or substitutional features of the invention are described below.

The profile of said flanks is a continuous curve formed by two circular arcs which are mutually tangential.

The profile of said flanks comprises, at one of its distal portions, a segment connected to the thread crest, respectively to the thread root, by means of a radius of curvature.

The segment forms an angle with the axis passing through the thread crest, respectively the thread root, which is in the range 30 to 60 degrees.

The angle formed by the segment with the axis passing through the thread crest, respectively the thread root, is substantially equal to 45 degrees.

The radius of curvature connecting the profile to the thread crest, respectively the root, is in the range 0.5 to 2.5 mm.

The radius of curvature connecting the profile to the thread crest, respectively the root, is substantially equal to 1 mm.

The threaded zone has a taper generatrix forming an angle with the axis of the tubular component which is in the range from 1 degree to 5 degrees, such that the radial height of the stabbing flank of a given thread is greater than the radial height of the load flank of said thread.

The radial height of the segments is in the range 50% to 100% of the difference between the height of the stabbing flank and the height of the load flank.

The radial height of the segments is equal to the difference between the height of the stabbing flank and the height of the load flank.

The thread crests and roots are parallel to the axis of the tubular component.

The invention also concerns a threaded connection comprising a first and a second tubular component, each being provided with a respective male and female end, the male end comprising on its external peripheral surface at least one threaded zone and finishing in a terminal surface which is orientated radially with respect to the axis of the connection, the female end comprising on its internal peripheral surface at least one threaded zone and finishing in a terminal surface which is orientated radially with respect to the axis of the connection, the male threaded zone having at least one portion which can cooperate in a self-locking tightening with a corresponding portion of the female threaded zone, the first and second tubular components being in accordance with the invention.

In accordance with certain characteristics, a clearance h is provided between the crest of the teeth of the male threaded zone and the root of the female threaded zone.

In accordance with other characteristics, the male and female ends each respectively comprise a sealing surface which can cooperate together in tightening contact when portions of the threaded zones cooperate following self-locking make-up.

In accordance with other characteristics, the threaded connection is a threaded connection of a drilling component.

The characteristics and advantages of the invention are set out in more detail in the following description, made with reference to the accompanying drawings.

Figure 1:
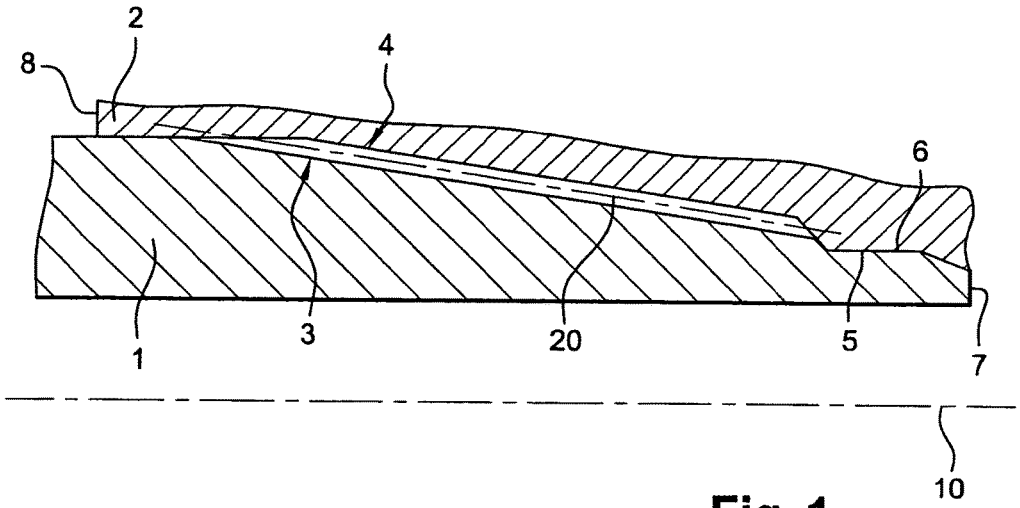
FIG. 1 is a diagrammatic view of a connection resulting from connecting two tubular components by make-up of self-locking zones, the connection being in accordance with the invention.

The threaded connection shown in FIG. 1 comprises, in known manner, a first tubular component with an axis of revolution 10 provided with a male end 1 and a second tubular component with an axis of revolution 10 provided with a female end 2. The two ends 1 and 2 each finish in a terminal surface 7, 8 which is orientated radially with respect to the axis 10 of the threaded connection which is not in abutment, and are respectively provided with threaded zones 3 and 4 which cooperate together for mutual connection by make-up of the two components. The threaded zones 3 and 4 are of known type and termed "self-locking" (also said to have a progressive variation of the axial width of the threads and/or the intervals between threads), such that progressive axial tightening occurs during make-up until a final locking position is reached.

Figure 2:
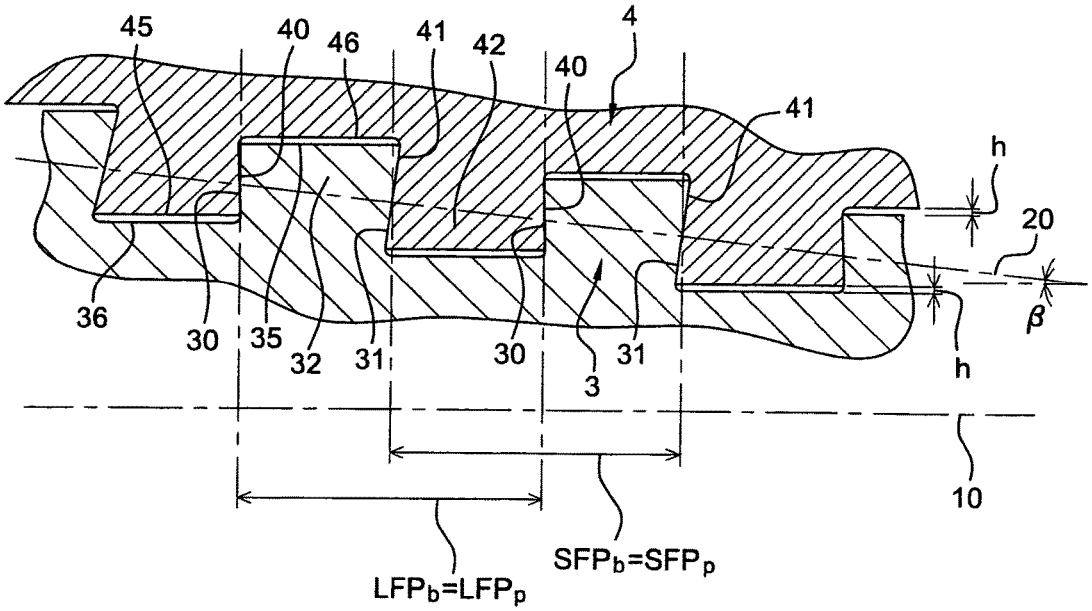
FIG. 2 is a detailed diagrammatic view of the made up self-locking cooperation of the connection of FIG. 1.

In known manner and as can be seen in FIG. 2, the term "self-locking threaded zones" means threaded zones including the features detailed below. The flanks of the male threads (or teeth) 32, like the flanks of the female threads (or teeth) 42, have a constant lead while the width of the threads decreases in the direction of the respective terminal surfaces 7, 8, such that during make-up the male threads (or teeth) 32 and female threads (or teeth) 42 finish by locking into each other in a predetermined position.

More precisely, the lead LFPb between the load flanks 40 of the female threaded zone 4 is constant, as is the lead SFPb between the stabbing flanks 41 of the female threaded zone, wherein in particular the lead between the load flanks 40 is greater than the lead between the stabbing flanks 41.

Similarly, the lead SFPp between the male stabbing flanks 31 is constant, as is the lead LFPp between the male load flanks 30. Further, the respective leads SFPp and SFPb between the male 31 and female 41 stabbing flanks are equal to each other and also smaller than the respective leads LFPp and LFPb between the male 30 and female 40 load flanks, which are also equal to each other.

As can be seen in FIG. 2, and as is known in the art, the male and female threads (or teeth) have a profile, viewed in longitudinal section passing through the axis of the threaded connection, which has the general appearance of a dovetail such that they are solidly fitted one into the other after make-up. This additional guarantee means that risks known as "jump-out", corresponding to the male and female threads coming apart when the connection is subjected to large bending or tensile stresses, are avoided. More precisely, the geometry of the dovetail threads increases the radial rigidity of their connection compared with threads which are generally termed "trapezoidal" with an axial width which reduces from the root to the crest of the threads.

Figure 3:
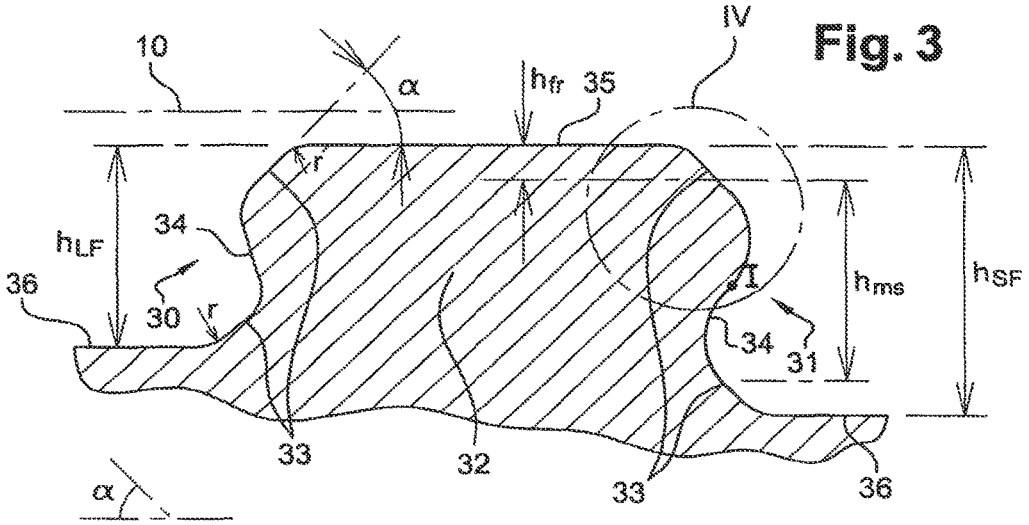
FIG. 3 is a detailed view of a thread of the male end of a tubular connection component in accordance with the invention.

FIG. 3 shows a view, in a longitudinal section passing through the axis 10 of a tubular component, of a thread 32 in accordance with a mode of the invention. This thread belongs to the male end 1 of said tubular component. In accordance with the invention, the profile of the load flanks 30 and/or the stabbing flanks 31 has as the central portion a continuous curve 34 provided with a point of inflection (I), said profile being connected to the crest 35 and the root 36 of the thread by means of a radius of curvature. It should be noted that the term "central portion of the profile" means the major portion of the profile excluding the ends of the profile. It should also be noted that the central portion of the profile is termed a curve in the sense that it is not rectilinear. The central portion of the profile which is termed "curved" is thus to be taken to mean the opposite of a central portion which is termed "straight". This curve is continuous in the sense that it does not comprise a singular point, and so the tangent is always defined. This means that there is no angular point which would then be the seat of stress concentration. The flank profile is also connected to the thread crest 35 and the root 36 by means of a radius of curvature.

More precisely, the radius of curvature is connected tangentially to the thread crest 35 and root 36, as is the flank profile. Further, the curve 34 has a point of inflection (I). This means that connection of the profile to the thread crest and to the thread root is made without an angular point, of the cusp type or other type. Further, at the thread crest the profile has a convex shape, and a concave shape at the thread root, so that the resistance to stress during make-up of the connection and in service are improved. It will also be recalled that in a self-locking threaded connection, contact between the threads is very high since it ensures locking of the two tubular components, and above all, it occurs on the flanks. For this reason, it is important that the flanks do not have any geometric weaknesses such as low rounding radii. It will also be noted that machining tolerances are easier to adhere to for large radii of curvature than for small radii of curvature.

It will be noted that the flank profile as prescribed by the invention may be applied either to the load flanks of a tubular component or to the stabbing flanks of said tubular component, or to both. However, it is particularly advantageous to apply it to at least the stabbing flanks as these are the flanks which are the most stressed during the make-up operation. In other words, they run the greatest risk of galling. However, the flank profile applied to the load flanks allows the male end to be disengaged from the female end more easily.

It should also be noted that the continuous curve may be based on equations of the polynomial, elliptical, parabolic or sinusoidal type.

Figure 5:
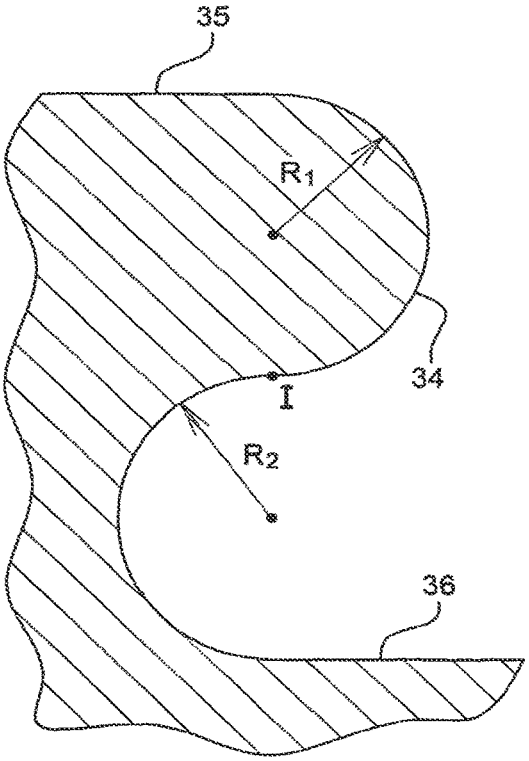
FIG. 5 is a detailed view of a thread of a male end of a tubular connection component in accordance with a second particular embodiment.

As an example, in accordance with a particular embodiment as described in FIG. 5, the profile of said flanks is a continuous curve formed by two circular arcs which are mutually tangential and with respective radii R1 and R2.

Figure 4:
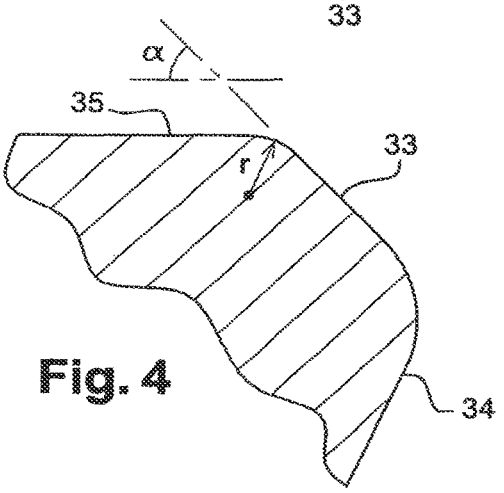
FIG. 4 is a detailed view of a male end thread of a tubular connection component in accordance with a first particular embodiment.

In accordance with another embodiment, described in FIG. 4, the profile of said flanks has as the central portion a continuous curve comprising at each of its ends a segment 33 connected tangentially to the thread crest 35, respectively to the thread root 36, by means of a radius of curvature (r). The two segments 33 thus each constitute a rectilinear portion on the curve 34. Its rectilinear portions have the advantage of providing surfaces which act as a ramp during make-up of the two tubular components.

Advantageously, the segments 33 form an angle $\alpha$ with the crest 35, respectively the root 36 of the thread, in the range 30 to 60 degrees, preferably substantially equal to 45 degrees.

Advantageously again, the radius (r) is in the range 0.5 to 2.5 mm, preferably substantially equal to 1 mm.

Advantageously and as can be seen in FIG. 2, the threadings 3 and 4 of the tubular components are orientated along a taper generatrix 20 so as to facilitate the progress of make-up. In general, this taper generatrix forms an angle with the axis 10 which is included in a range from 1 degree to 5 degrees. In the present case the taper generatrix is defined as passing through the middle of the load flanks. For this reason, the radial height $h_{SF}$ of the stabbing flank of a given thread is greater than the radial height $h_{LF}$ of the load flank of said thread.

In accordance with an advantageous mode using tapered threadings and as can be seen in FIG. 3, the radial height $h_{fr}$ of the segments 33 is in the range 50% to 100% of the difference between the radial height $h_{SF}$ of the stabbing flank and the radial height $h_{LF}$ of the load flank. The minimum required for the height of the stabbing flank means that a flat bearing surface is obtained at the segments 33 which is sufficient to stabilize the contact between the male element and the female element during make-up, which distributes the stresses more effectively. The required maximum corresponds to an acceptable flank profile, i.e. without too much curvature.

In accordance with a preferred mode using tapered threadings and as can be seen in FIG. 3, the radial height $h_{fr}$ of segments 33 is equal to the difference between the radial height $h_{SF}$ of the stabbing flank and the radial height $h_{LF}$ of the load flank.

Advantageously and as can be seen in FIG. 2, the crests and the roots of the male and female threaded zones are parallel to the axis 10 of the threaded connection. This facilitates machining.

As detailed above, contact is principally made between the male 30 and female 40 load flanks, and also for the male 31 and female 41 stabbing flanks. In contrast, a clearance (h) may be provided between the male thread crests and the female thread roots; similarly, a clearance (h) may be provided between the male thread roots and the female thread crests, so as to facilitate progress during make-up and to avoid any risks of galling.

Advantageously and as can be seen in FIG. 1, the fluid-tight seal, both to the interior of the tubular connection and to the external medium, is provided by two sealing zones 5, 6 located close to the terminal surface 7 of the male element.

It is known that mud moves under pressure inside the drill string to the bottom of the well in order to guarantee proper operating the drill bit and to lift debris to the surface. Under certain drilling conditions or service conditions for the connections, pressurized gas may occur. The seal, provided up to this point by the abutment surfaces, is then no longer guaranteed. It is thus necessary to guarantee a greater degree of sealing corresponding to high pressures at the connection between two components. To this end, in other types of connections, such as VAM® TOP connections described by the Applicant in catalogue no 940, it is known to provide a sealing surface intended to cooperate in a radial tightening with a sealing surface provided on the female end of the connection on the male end of the connection beyond the threaded zone.

The sealing zone 5 may have a domed surface which is turned radially outwardly, with a diameter which decreases towards the terminal surface 7. The radius of this domed surface is preferably in the range 30 to 100 mm. Too high a radius (>150 mm) of the domed surface induces disadvantages which are identical to those of cone-on-cone contact. Too small a radius (<30 mm) of this domed surface induces an insufficient contact width.

Facing this domed surface, the female end 2 has a tapered surface which is turned radially inwardly with a diameter which also decreases in the direction of the terminal surface 7 of the male element. The tangent of the peak half angle of the tapered surface is in the range 0.025 to 0.075, i.e. a taper in the range 5% to 15%. Too low a taper (<5%) for the tapered surface induces a risk of galling on make-up and too high a taper (>15%) necessitates very tight machining tolerances.

The inventors have discovered that such a contact zone between a tapered surface and a domed surface can produce a high effective axial contact width and a substantially semi-elliptical distribution of contact pressures along the effective contact zone, in contrast to contact zones between two tapered surfaces which have two narrow effective contact zones at the ends of the contact zone.

It should be noted that the sealing zones 5 and 6 of the male and female end may be disposed close to the terminal surface 8 of the female end.

A contact zone geometry in accordance with the invention means that a good effective contact width can be preserved despite variations in the axial positioning of the connected elements due to machining tolerances; the effective contact zone pivoting along the dome of the domed surface, retaining a parabolic local contact pressure profile.

Thus, in operation, i.e. when the threaded connections operate in bending, the principal advantage of the invention is that the flank profiles connect to the adjacent thread crest and root via roundings such that said roundings reduce the stress concentration factor at the foot of the flanks and thereby improve the fatigue behaviour of the connection.

The invention also has the advantage that the flank profiles are free from angular points, which also reduces the stress concentration factor in these zones where very high Hertz stresses are exerted. This type of profile also offers advantages during make-up of the components since they limit the risks of galling.

The invention claimed is:

1. A tubular component for a threaded connection, including at one of its ends a threaded zone formed on its external or internal peripheral surface depending on whether the threaded end is of a male or female type, said end of the tubular component including a terminal surface, said threaded zone including, over at least a portion thereof, a plurality of threads, such that each thread of the plurality of threads comprises, when viewed in a longitudinal section passing through an axis of the tubular component, a thread crest, a thread root, a load flank, and a stabbing flank, a respective axial width of thread crests of the plurality of threads decreases in a direction of the terminal surface while a respective axial width of thread roots of the plurality of threads increases in the direction of the terminal surface, wherein each load flank and each stabbing flank includes a profile, and at least one of the profile of the load flank and the profile of the stabbing flank, viewed in the longitudinal section passing through the axis of the tubular component, includes as a central portion a continuous curve provided with a point of inflection, said continuous curve with the point of inflection being convex adjacent to the thread crest and concave adjacent to the thread root, wherein the continuous curve with the point of inflection is connected respectively, at a first distal portion of the continuous curve to a first rectilinear segment, the first rectilinear segment being connected to the thread crest by a first radius of curvature, and at a second distal portion of the continuous curve, to a second rectilinear segment, the second rectilinear segment being connected to the thread root by a second radius of curvature, wherein a radial height of the first rectilinear segment is in a range 50% to 100% of a difference between a radial height of the stabbing flank and a radial height of the load flank, and wherein a radial height of the second rectilinear segment is in the range 50% to 100% of the difference between the radial height of the stabbing flank and the radial height of the load flank.

2. A tubular component for a threaded connection according to claim 1, wherein the profile with the point of inflection is the continuous curve formed by two circular arcs which arc mutually tangential.

3. A tubular component for a threaded connection according to claim 1, wherein each of the first and second rectilinear segments forms an angle with a respective axis passing through the thread crest or the thread root, which is in a range 30 to 60 degrees.

4. A tubular component for a threaded connection according to claim 3, wherein the angle is substantially equal to 45 degrees.

5. A tubular component for a threaded connection according to any one of claims 1, 3, and 4, wherein the first and second radius of curvature connecting the profile with the point of inflection respectively to the thread crest or to the thread root, is in a range 0.5 to 2.5 mm.

6. A tubular component for a threaded connection according to claim 5, wherein the first and second radius of curvature is substantially equal to 1 mm.

7. A tubular component for a threaded connection according to claim 1, wherein the threaded zone includes a taper generatrix forming an angle with the axis of the tubular component such that the radial height of the stabbing flank of a given thread is greater than the radial height of the load flank of said thread.

8. A tubular component for a threaded connection according to claim 1, wherein the thread crests and the thread roots are parallel to the axis of the tubular component.

9. A threaded connection comprising a first and a second tubular component, each being provided with a respective male and female end, the male end comprising on its external peripheral surface at least one male threaded zone and finishing in a terminal surface, the female end comprising on its internal peripheral surface at least one female threaded zone and finishing in a terminal surface, the male threaded zone including at least one portion which is cooperable in a self-locking tightening with a corresponding portion of the female threaded zone, wherein the first and second tubular components are each a tubular component according to claim 1.

10. A threaded connection according to claim 9, wherein a clearance is provided between a crest of teeth of the male threaded zone and a root of the female threaded zone.

11. A threaded connection according to claim 9, wherein the male and female ends each respectively comprise a sealing surface which is cooperable together with a tightening contact when portions of the male and female threaded zones cooperate following self-locking make-up.

12. A threaded connection according to claim 9, wherein the threaded connection is a threaded connection of a drilling component.

* * * * *